US009523225B2

(12) United States Patent
Smith

(10) Patent No.: US 9,523,225 B2
(45) Date of Patent: Dec. 20, 2016

(54) CONCEALED HINGE

(71) Applicant: Austin Hardware & Supply, Inc., Lee's Summit, MO (US)

(72) Inventor: Norman Allen Smith, Buford, GA (US)

(73) Assignee: AUSTIN HARDWARE AND SUPPLY, INC., Lee's Summit, MO (US)

( * ) Notice: Subject to any disclaimer, the term of this patent is extended or adjusted under 35 U.S.C. 154(b) by 0 days.

(21) Appl. No.: 14/660,242

(22) Filed: Mar. 17, 2015

(65) Prior Publication Data

US 2015/0259960 A1 Sep. 17, 2015

Related U.S. Application Data

(60) Provisional application No. 61/954,311, filed on Mar. 17, 2014.

(51) Int. Cl.
*E05D 3/06* (2006.01)
*E05D 3/14* (2006.01)

(52) U.S. Cl.
CPC ..... *E05D 3/147* (2013.01); *E05D 3/142* (2013.01); *E05Y 2600/41* (2013.01); *E05Y 2900/518* (2013.01); *Y10T 16/533* (2015.01)

(58) Field of Classification Search
CPC ..... Y10T 16/547; Y10T 16/5474; Y10T 16/5475; Y10T 16/5476; Y10T 16/558; Y10T 16/5595; E05D 3/06; E05D 3/12; E05D 3/14; E05D 3/142; E05D 3/16; E05D 3/125; E05D 3/127; E05D 5/062; E05Y 2600/41; E05Y 2600/412; E05Y 2600/45; E05Y 2600/452;E05Y 2600/46; E05Y 2900/50; E05Y 2900/531; E05Y 2900/546
See application file for complete search history.

(56) References Cited

U.S. PATENT DOCUMENTS 2,001,356 A * 5/1935 Bates ..... E05D 3/18 16/358
2,179,113 A * 11/1939 Bates ..... E05D 3/02 16/235
2,309,001 A * 1/1943 Nave ..... E05D 3/02 16/379
2,596,816 A * 5/1952 Lieberman ..... E05D 3/06 16/358
2,694,216 A * 11/1954 Schnur ..... E05D 3/16 16/369
2,901,766 A * 9/1959 Marquis ..... E05D 3/147 16/370

(Continued)

FOREIGN PATENT DOCUMENTS

KR 20120125998 A * 11/2012

*Primary Examiner* — Chuck Mah
(74) *Attorney, Agent, or Firm* — Polsinelli PC

(57) ABSTRACT

A concealed hinge is described. The concealed hinge may be used in the utility body vehicle market. The concealed hinge includes a first housing. The first housing holds a first pin and a second pin. The concealed hinge includes a second housing. The second housing holds a third pin and a fourth pin. The concealed hinge includes a linkage, which includes a central link, an upper link, and a lower link. The first pin and the second pin engage the first housing to the linkage. The third pin and the fourth pin engage the second housing to the linkage.

21 Claims, 10 Drawing Sheets

(56) References Cited

U.S. PATENT DOCUMENTS

| | | | | | |
|---|---|---|---|---|---|
| 3,001,224 | A * | 9/1961 | Soss | E05D 3/16 | 16/276 |
| 3,881,221 | A * | 5/1975 | Schmidt | E05D 3/186 | 16/273 |
| 3,886,627 | A * | 6/1975 | Bassan | E05D 3/186 | 16/360 |
| 5,685,046 | A * | 11/1997 | Neag | E05D 3/127 | 16/334 |
| 7,721,389 | B2 * | 5/2010 | Wildman | E05D 5/065 | 109/74 |
| 2002/0023314 | A1 * | 2/2002 | Goldsmith | E05D 3/186 | 16/372 |
| 2003/0088943 | A1 * | 5/2003 | Neukotter | E05D 3/186 | 16/366 |
| 2008/0222844 | A1 * | 9/2008 | Broadhead | E05D 3/16 | 16/231 |
| 2008/0289146 | A1 * | 11/2008 | Chen | E05D 3/186 | 16/372 |
| 2009/0070960 | A1 * | 3/2009 | Elliott | E05D 3/127 | 16/334 |
| 2009/0106940 | A1 * | 4/2009 | Greenbank | E05D 3/127 | 16/367 |
| 2010/0122431 | A1 * | 5/2010 | Neukoetter | E05D 3/186 | 16/238 |
| 2012/0180396 | A1 * | 7/2012 | Liermann | E05D 3/186 | 49/398 |
| 2013/0104340 | A1 * | 5/2013 | Hasler | E05D 7/0027 | 16/238 |

* cited by examiner

CONCEALED HINGE

CROSS REFERENCE TO RELATED APPLICATION

This application claims the benefit of U.S. Provisional Patent Application No. 61/954,311 filed Mar. 17, 2014, which is hereby incorporated by reference in its entirety.

FIELD OF INVENTION

The present invention relates to a concealed hinge.

SUMMARY OF INVENTION

A concealed hinge is described. The concealed hinge may be used in the utility body vehicle market. The concealed hinge may be used with doors on the back of ambulances. The doors may close a bay of the ambulance. The concealed hinge includes a first housing connected to a second housing via a linkage. The first housing may be attached or integrated into the door frame. The second housing may be attached or integrated into the door. The concealed hinge may also be used with a variety of doors, compartments and covers of vehicles and stationary cabinets, lockers, and structures. The concealed hinge may be used in other vehicles such as emergency vehicles, utility vehicles, and other commercial vehicles.

The concealed hinge provides for the door to rotate approximately 180°. As such, the door may be fully opened to provide unobstructed access to an interior of the bay of the ambulance or an interior of a compartment. The concealed hinge operates like a normal hinge until it gets to the 90° point, and then the linkage of the concealed hinge allows the door to pivot the remainder until the approximately 180° point of the door is reached. When the door is fully opened, the concealed hinge also minimizes the hinge links protrusion into the opening of the doorway.

In one aspect, a concealed hinge includes a first housing. The first housing holds a first pin and a second pin. The concealed hinge includes a second housing. The second housing holds a third pin and a fourth pin. The concealed hinge includes a linkage, which includes a central link, an upper link, and a lower link. The first pin and the second pin engage the first housing to the linkage. The third pin and the fourth pin engage the second housing to the linkage.

DETAILED DESCRIPTION OF INVENTION

A concealed hinge 10 will now be described with reference to FIGS. 1-10. The concealed hinge 10 includes a linkage 50 that connects a door with a door frame of a vehicle. The concealed hinge 10 allows the door to fully open to provide unobstructed access to an interior of the vehicle.

The concealed hinge 10 includes a first housing 100 and a second housing 300. The first housing 100 may be attached to a door frame of a vehicle. In other aspects, the frame may be part of an opening of a compartment, cabinet, locker, structure, or the like. The second housing 300 may be attached to the door, panel, or other closure that covers or closes the opening of the compartment, cabinet, locker, structure, or the like.

Figure 1:
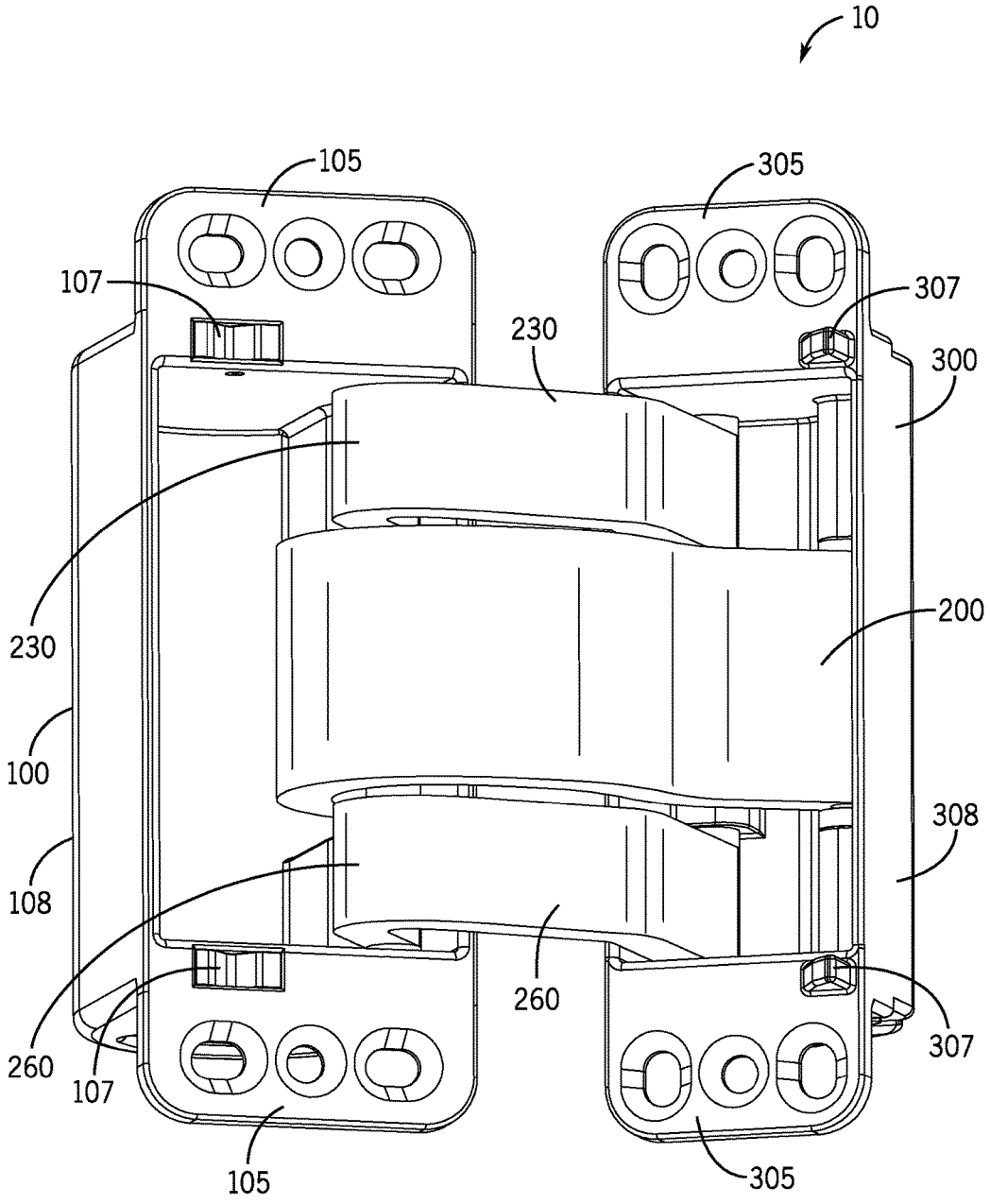
FIG. 1 is a perspective view of the concealed hinge in an open position.
Figure 2:
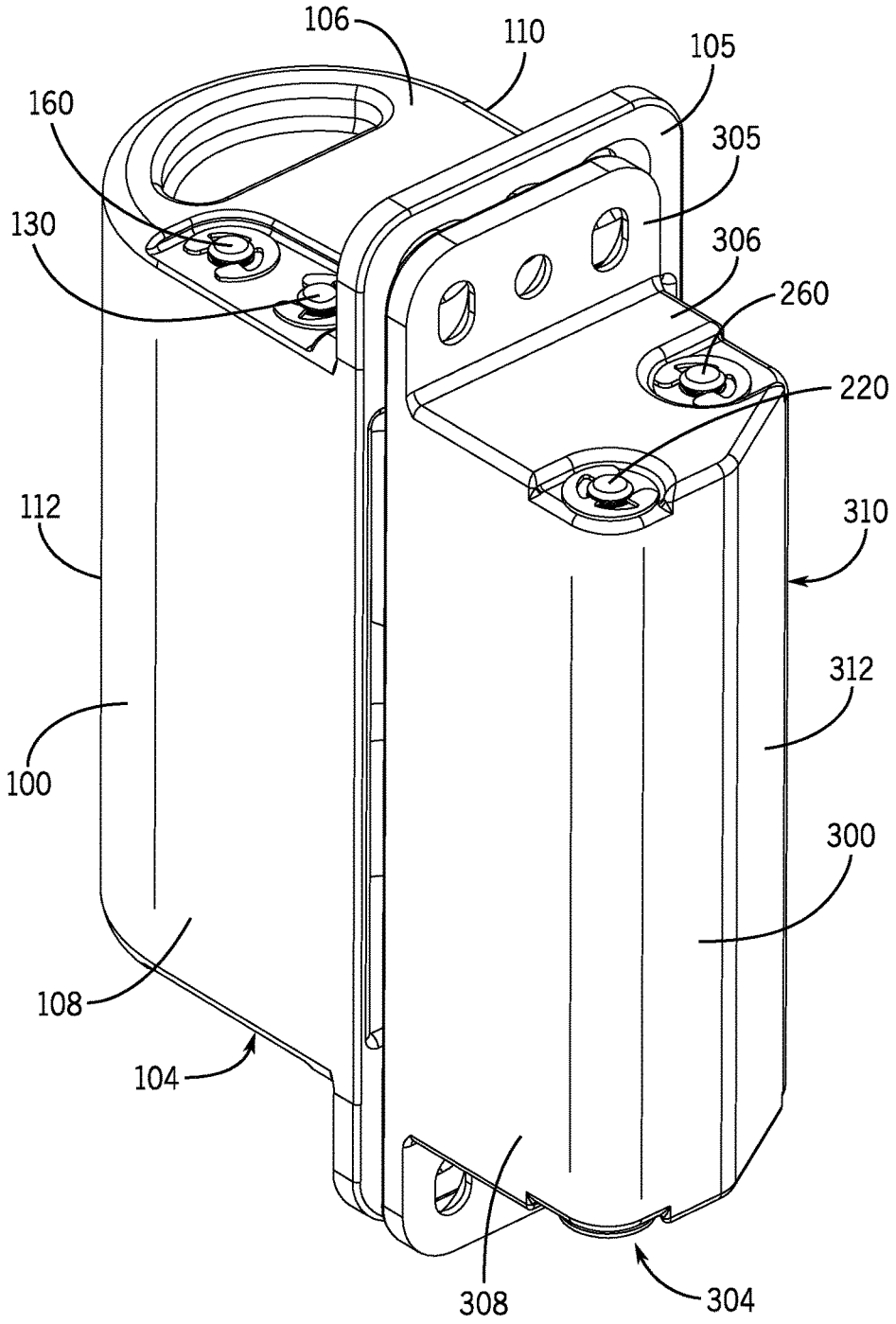
FIG. 2 is a perspective view of the concealed hinge in a closed position.
Figure 3:
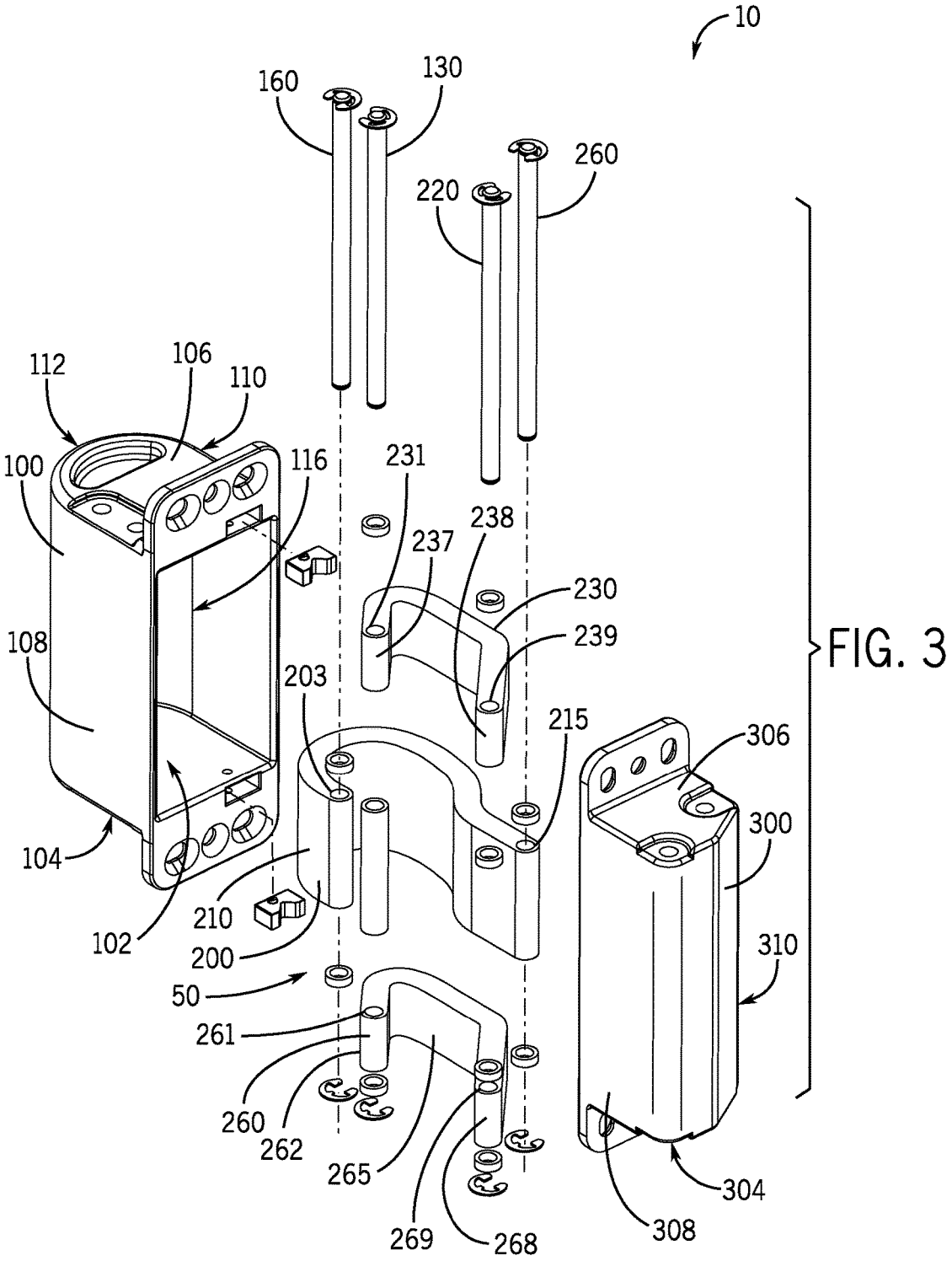
FIG. 3 is an exploded view of the concealed hinge.
Figure 4:
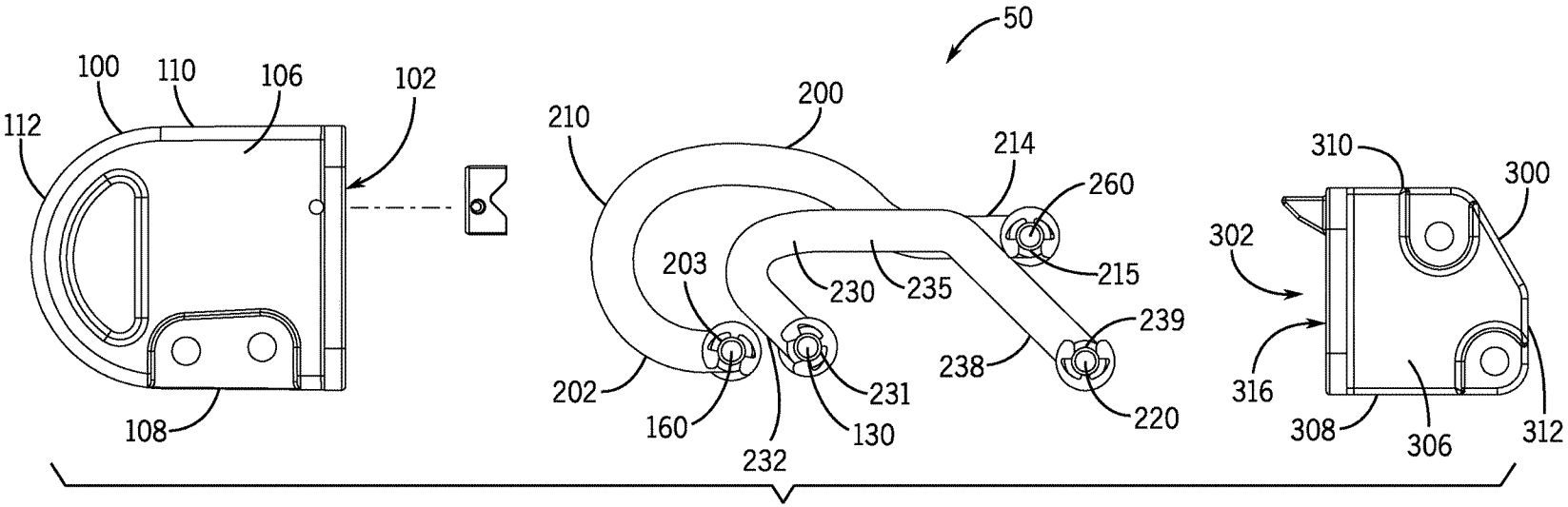
FIG. 4 is a top down exploded view of the concealed hinge.

An exploded view of the hinge 10 is shown in FIG. 3. The hinge 10 includes the linkage 50 that connects the first housing 100 and the second housing 300. The linkage 50 provides for the full opening of the door. The linkage 50 includes a central link 200, an upper link 230, and a lower link 260. The central link 200 may be positioned between the upper link 230 and the lower link 260.

In the closed position, the linkage 50 of the concealed hinge 10 is almost totally concealed by the first housing 100 and the second housing 300. Further, the first housing 100 may be built into the door frame and the second housing 300 may be built into the door.

The first housing 100 includes an opening 102 defined by a bottom wall 104, a top wall 106, a front wall 108, a rear wall 110, and a lateral wall 112. The walls 104, 106, 108, and 110 define an opening 114 leading into an interior 116 of the first housing 100.

The second housing 300 includes an opening 302 defined by a bottom wall 304, a top wall 306, a front wall 308, a rear wall 310, and a lateral wall 312. The walls 304, 306, 308, and 310 define the opening 302 leading into an interior 316 of the second housing 300.

The first housing 100 engages a first pin 130 and a second pin 160. The first pin 130 and the second pin 160 are positioned along the front wall 108 of the first housing 100. The first pin 130 and the second pin 160 may be in a parallel alignment along the front wall 108 of the first housing 100. The first pin 130 is closer to the opening 102 than the second pin 160. The first pin 130 may be positioned between the opening 102 and the second pin 160. The first pin 130 and the second pin 160 extend from the bottom wall 104 of the first housing 100 to the top wall 106 of the first housing 100. In the aspect shown in FIGS. 1-10, the pins 130 and 100 extend through the bottom wall 104 and the top wall 106. Clips hold ends of the pins 130 and 160 relative to the bottom wall 104 and the top wall 106. Although the pins 130 and 160 are fixed in position in the first housing 100, the pins 130 and 160 may freely rotate within the first housing 100. Any type of pin can be used to hold the links to the body, i.e., headed, drilled and pinned, press fit that allows the links to rotate freely.

The second housing 300 engages a third pin 220 and a fourth pin 260. The fourth pin 260 is positioned deeper in the second housing 300 than the third pin 220, i.e., the fourth pin 260 is positioned closer to the rear wall 310. The third pin 220 and the fourth pin 260 are arranged in an off-set manner with the third pin 220 adjacent to the front wall 308 and to the lateral wall 312, while the fourth pin 260 is adjacent to the rear wall 310. The fourth pin 260 is positioned closer to the opening 316 than the third pin 220. The third pin 220 may be in a parallel alignment with the first pin 130 and the second pin 160. The third pin 220 and the fourth pin 260 extend from the bottom wall 304 of the second housing 300 to the top wall 306 of the second housing 300. In the aspect shown in the FIGS. 1-10, the pins 220 and 260 extend through the bottom wall 304 and the top wall 306. Clips hold ends of the pins 220 and 260 relative to the bottom wall 304 and the top wall 306. Although the pins 220 and 260 are fixed in position in the second housing 300, the pins 220 and 260 may freely rotate within the second housing 300.

Figure 5:
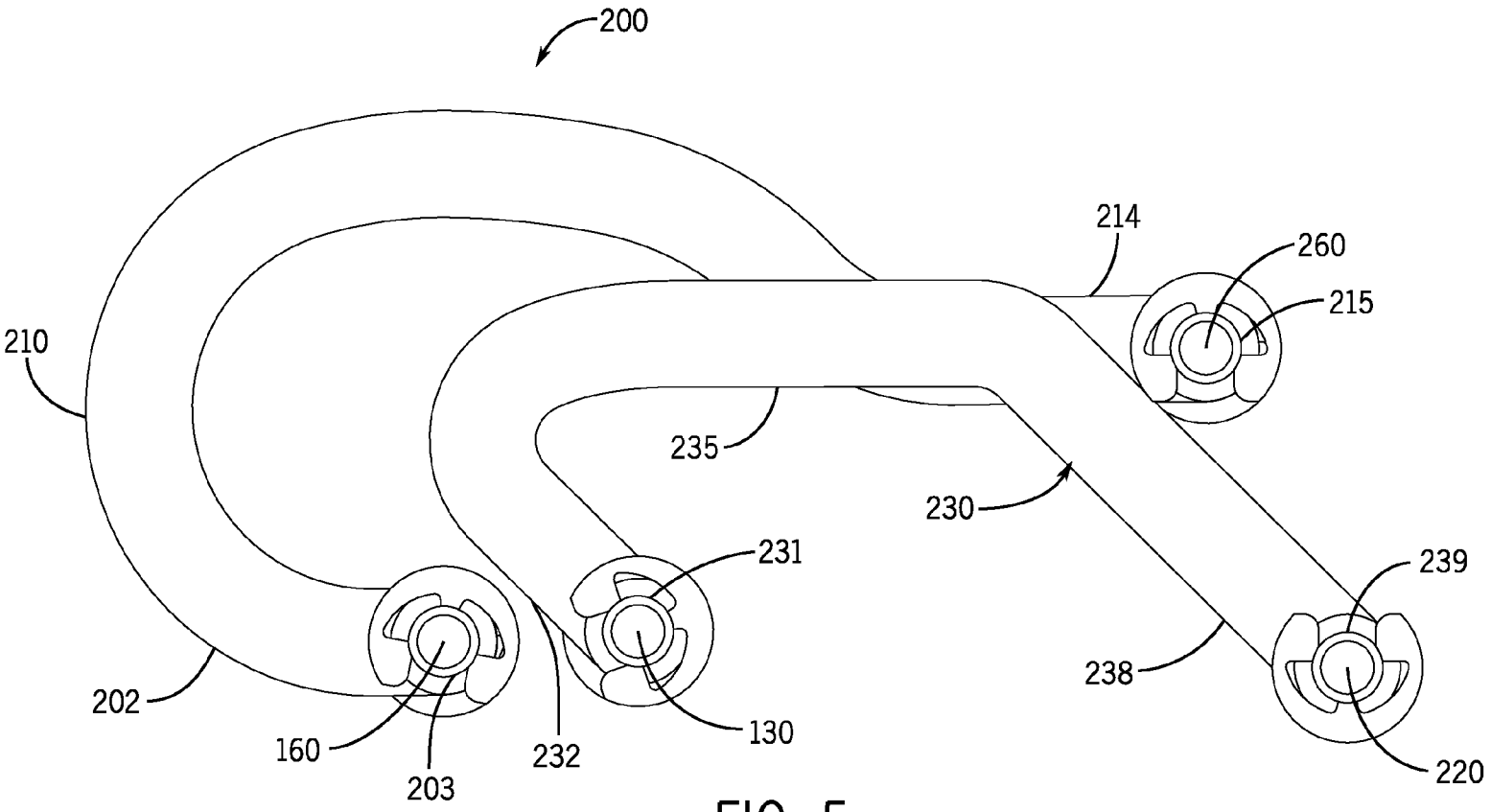
FIG. 5 is a top down exploded view of the linkage.
Figure 6:
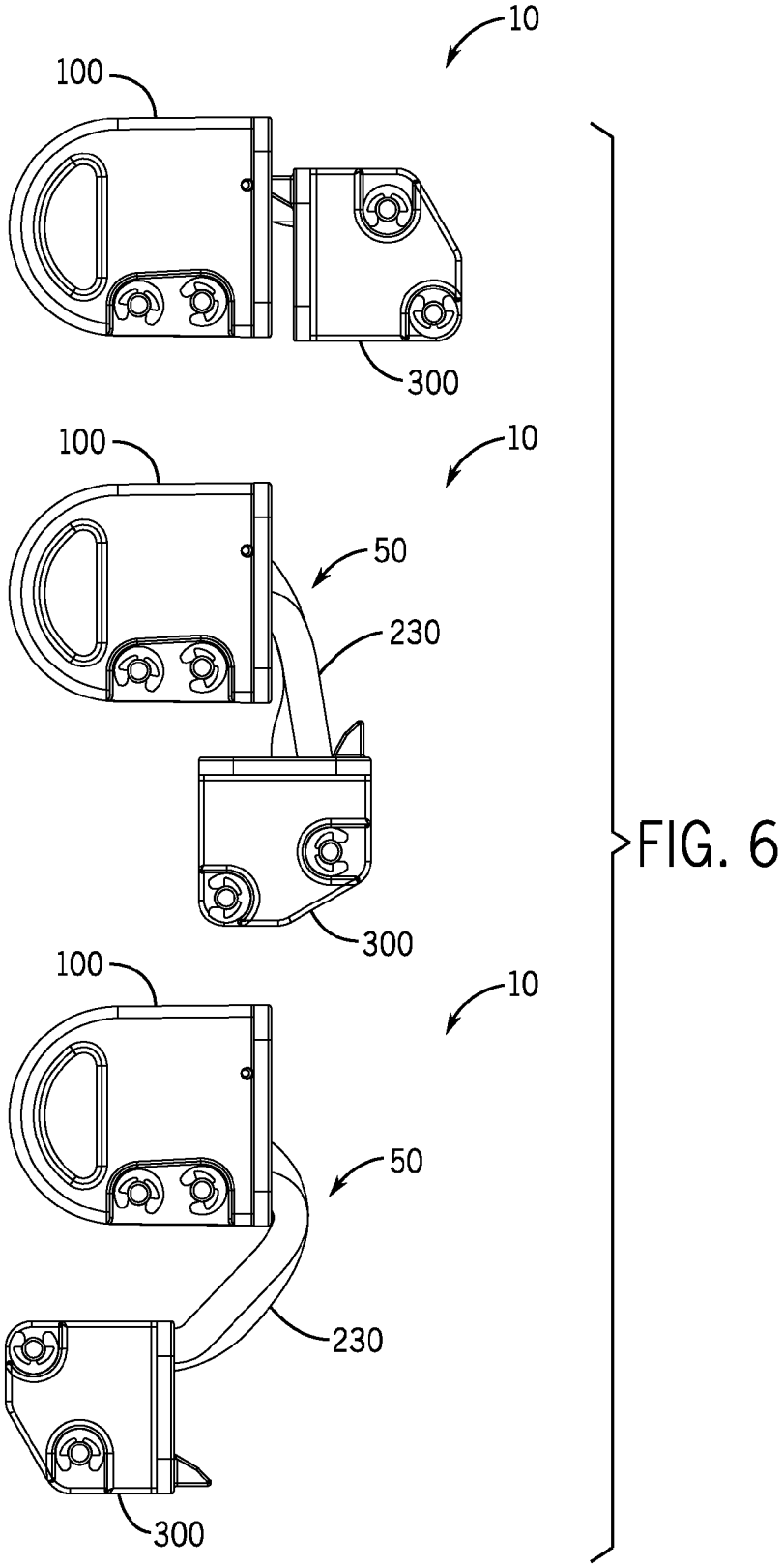
FIG. 6 is a view of the concealed hinge moving from the closed position to the open position.
Figure 7:
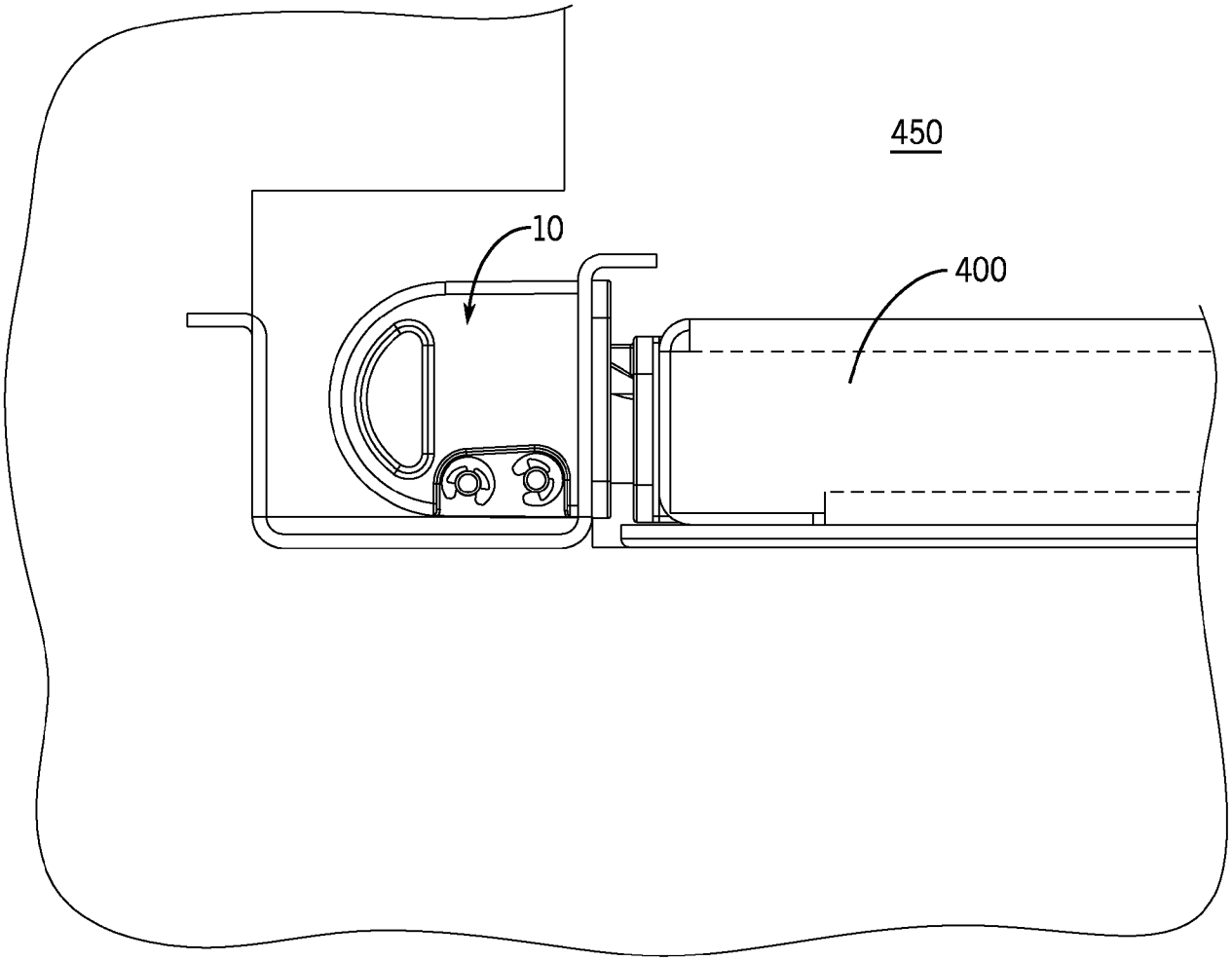
FIG. 7 is a view of the concealed hinge in the closed position.
Figure 8:
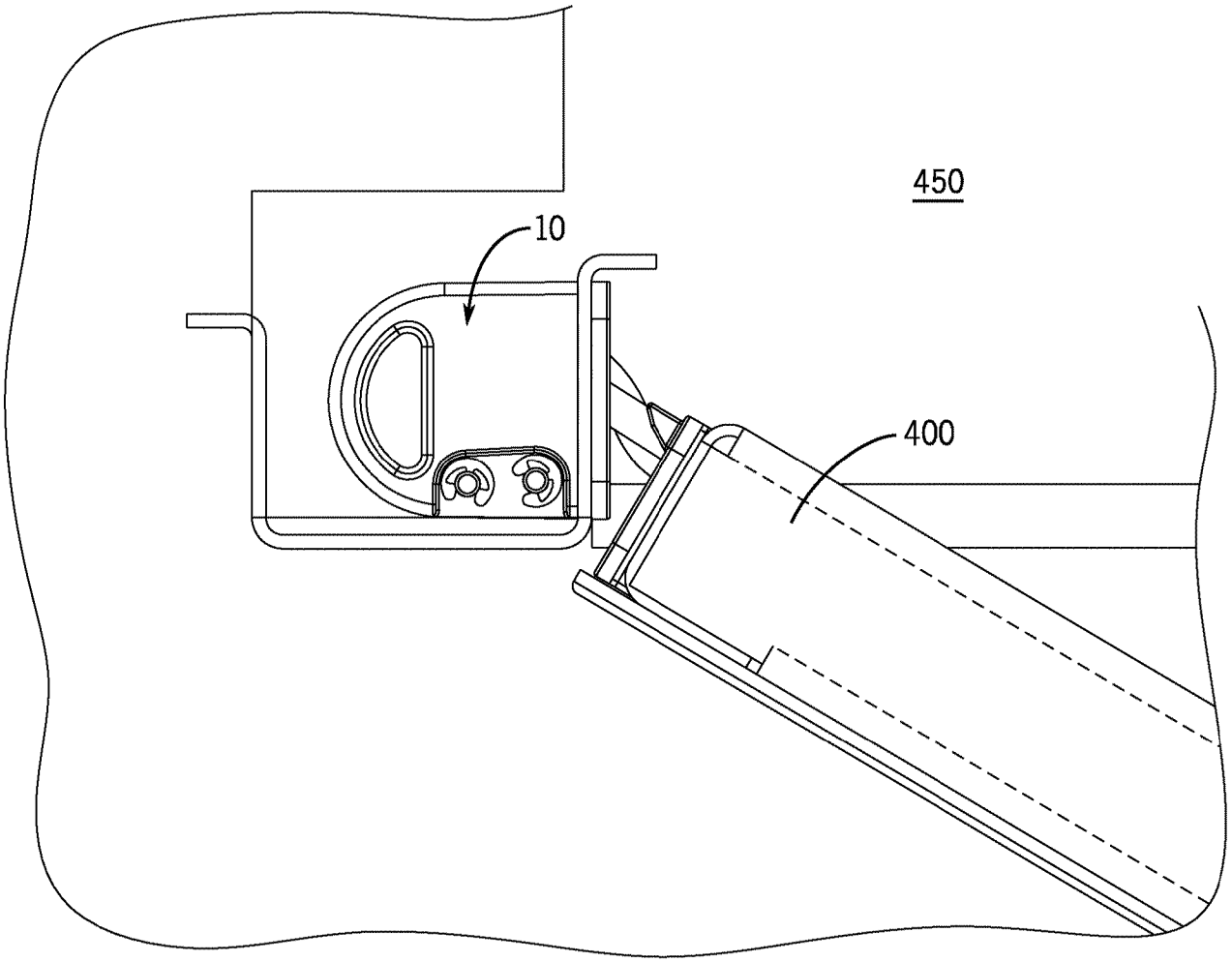
FIG. 8 is a view of the concealed hinge in the partially opened position.
Figure 9:
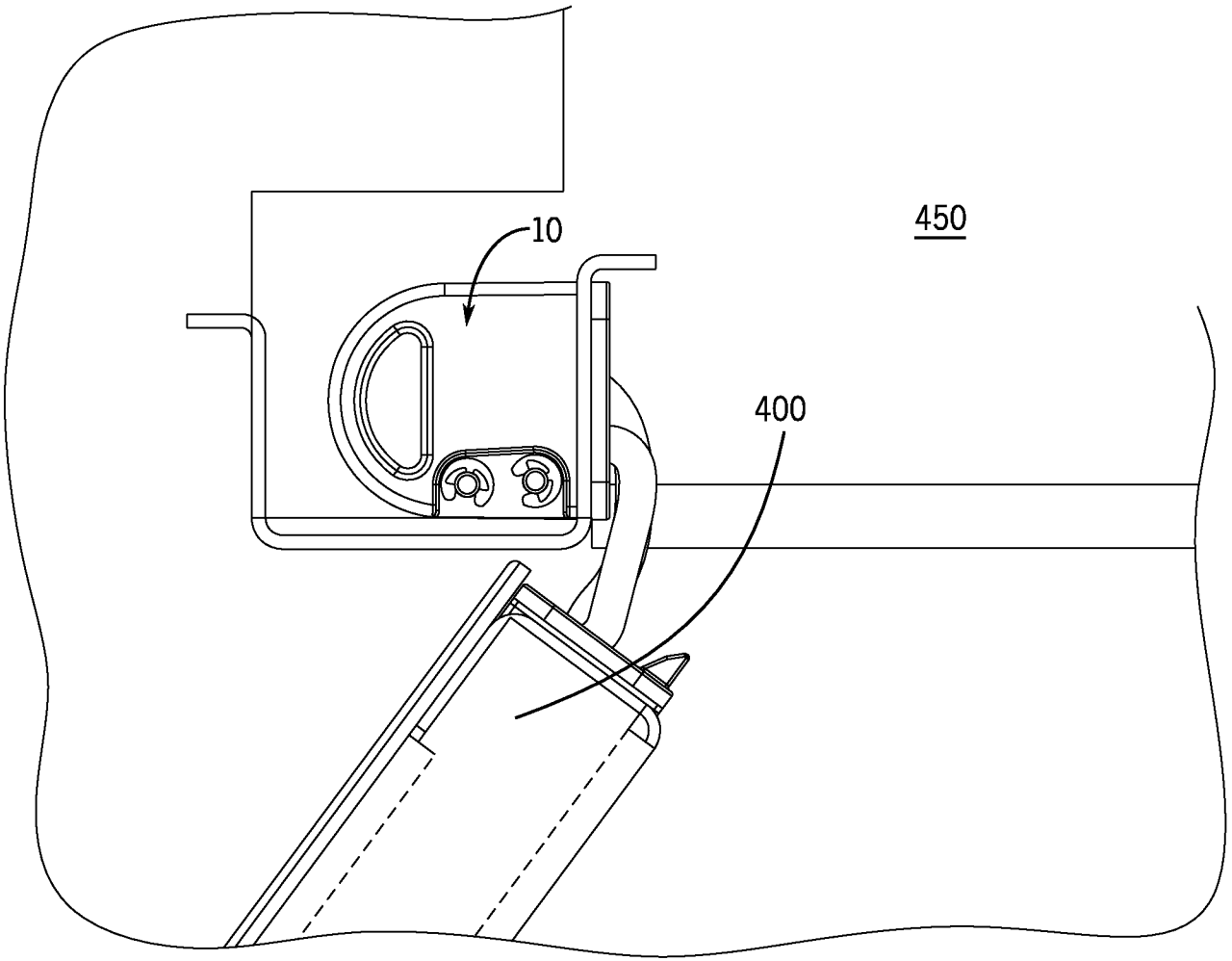
FIG. 9 is a view of the concealed hinge in the nearly fully opened position.
Figure 10:
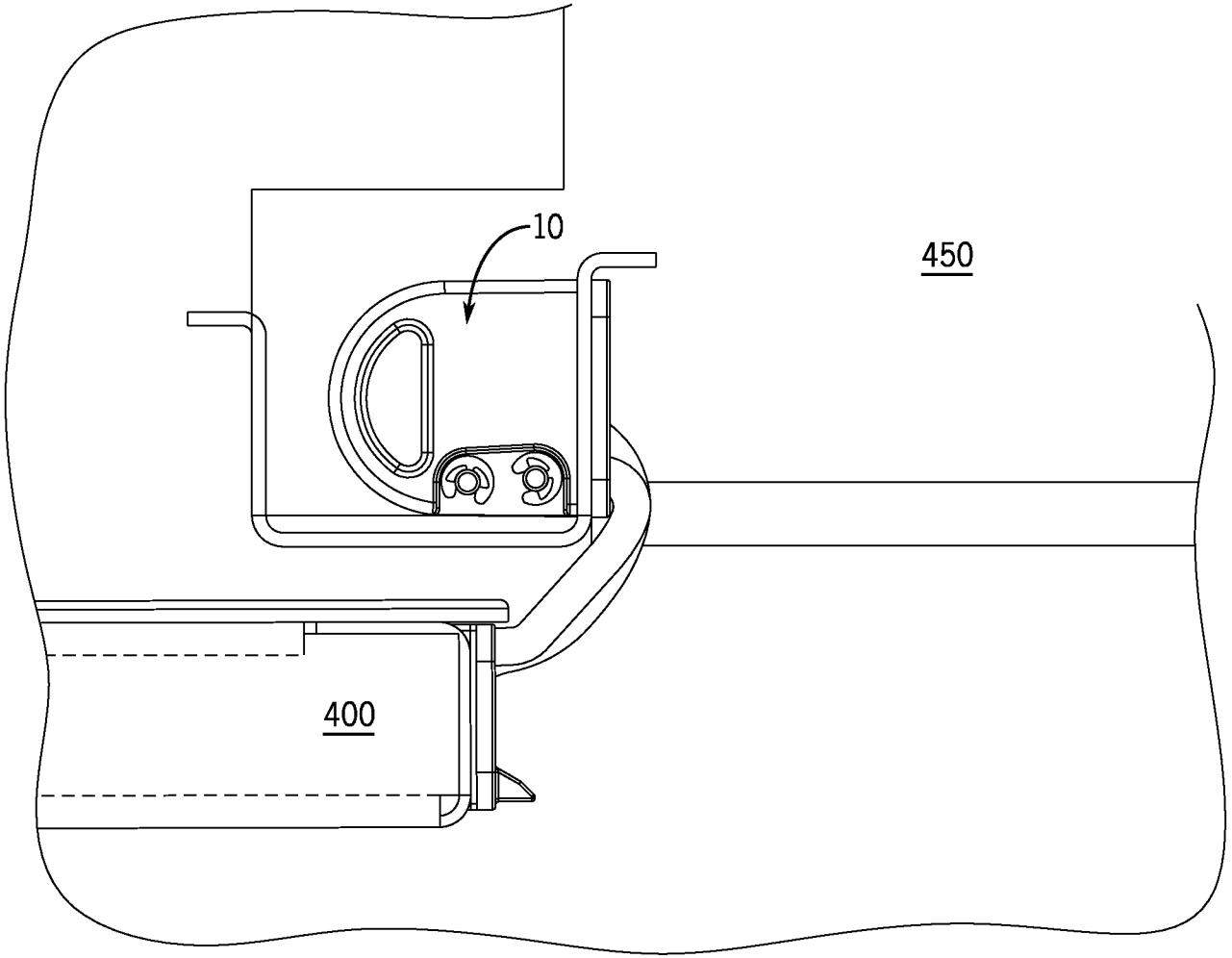
FIG. 10 is a view of the concealed hinge in the fully opened position.

With reference to FIG. 5, the central link 200 includes an inner end 202 and an outer end 214. The inner end 202 of the central link 200 transitions into a first curved portion 210. The first curved portion 210 includes an arcuate portion, which may form a semi-circular shape. The first curved portion 210 transitions into the outer end 214. The arcuate shape may initially curve away from the opening 102, and then begin to curve back toward the opening 102 in order to engage with the fourth pin 260. In a closed position, the inner end 202 extends generally opposite to the opening 102 before the first curved portion 210 curves back to pass through the opening 102.

The upper and lowers link 230 and 260 may include a substantially similar construction. The lower link 260 includes an inner end 262 and an outer end 268. The upper link 230 includes an inner end 232 and an outer end 238. The inner ends 232 and 262 may angle away from the opening 102, and then bend back toward the opening 102. The links 230 and 260 may include the inner ends 232 and 262, middle portions 235 and 265, and the outer ends 238 and 268. The inner ends 232 and 262 may be shorter than the middle portions 235 and 265 and the outer ends 238 and 268. The inner ends 232 and 262 may angle away from the opening 102 and then curve back toward the opening 102 and transition into the middle portions 235 and 265. The inner ends 232 and 262 may form an approximate 45 degree angle relative to the middle portions 235 and 265. The outer ends 238 and 268 may be substantially parallel to the inner ends 232 and 262. In the closed position, the middle portions 235 and 265 extend toward the opening 102. The middle portions 235 and 265 transition into the outer ends 238 and 268. In the closed position, the outer ends 238 and 268 extend outward towards the door. The outer ends 238 and 268 engage with the third pin 220. The outer ends 238 and 268 may form an approximate 135 degree angle relative to the middle portions 235 and 265.

The first curved portion 210 of the inner end 202 includes a longer curving radius than the inner end 232, i.e., the first curved portion 210 angles deeper into the second housing 300 than the inner end 232. The first housing 100 has a larger volume than the second housing 300. The first housing 100 includes the larger volume to accommodate the first curved portion 210 of the central link 200. When the door is in a fully closed position, the first curved portion 210 is almost entirely inside of the first housing 100.

The inner end 202 of the central link 200 includes an opening 203. The second pin 160 passes through the opening 203. The central link 200 rotates relative to the second pin 160. The outer end 214 of the central link 200 also includes an opening 215. The fourth pin 260 passes through the opening 215. The central link 200 also rotates relative to the fourth pin 260.

The inner end 232 of the upper link 230 includes an opening 231. The inner end 262 of the lower link 260 includes an opening 261. The first pin 130 passes through the openings 231 and 261. The upper link 230 and the lower link 260 rotate relative to the first pin 130.

The outer end 238 of the upper link 230 includes an opening 239. The outer end 268 of the lower link 260 includes an opening 269. The third pin 220 passes through the openings 239 and 269. The upper link 230 and the lower link 260 also rotate relative to the third pin 220.

As the inner ends 232 and 262 of the upper link 230 and the lower link 260 are both rotatably mounted to the first pin 130, and the outer ends 238 and 268 of the upper link 230 and the lower link 260 are both rotatably mounted to the third pin 220, the upper link 230 and the lower link 260 move in unison. Although the openings 203, 215, 231, 239, 261, and 269 are described, the inner ends 202, 232, 262 and the outer ends 214, 238, and 268 may be bent or crimped to rotatably engage the pins 130, 160, 220, and 260.

FIGS. 6-10 show a door 400 closing over a compartment 450. The door 400 is engaged to the compartment 450 via the concealed hinge 10. The door 400 may pivot approximately 180° to fully open. The concealed hinge 10 allows the door 400 to rotate up to approximately 180 degrees from a closed position to an open position. The first curved portion 210 of the central link 200 and the angle between the inner ends 232 and 262 and the middle portions 235 and 265 provides for the approximately 180 degrees of rotation. The door 400 may rotate until the inner ends 232 and 262 hit the front wall 108 of the housing 100. At this point, the door 400 is fully opened and is approximately parallel to a rear wall of the vehicle.

The first housing 100 includes the lateral wall 112. The lateral wall 112 has a curved shape to approximately match the first curved portion 210 of the central link 200.

The first housing 100 may be mounted adjacent to the opening of the compartment. The front wall 104 of the first housing 100 may be mounted substantially parallel to the opening of the compartment. The second housing 300 may be mounted internally of the door. When the door is closed, almost all of the linkage 50 is within the first housing 100 and second housing 300. Posts 307 and rubber bumpers 107 may be incorporated to hold the hinge 10 steady and to help maintain proper alignment.

The first housing 100 may include a flange portion 105 with one or openings to mount to a door frame. The second housing 300 may include a flange portion 305 with one or more openings to mount to the door.

The concealed hinge 10 may be formed from all aluminum materials. In other aspects, the concealed hinge 10 may be formed from metals and metal alloys. The concealed hinge 10 may also be formed plastics and/or reinforced plastics (composite materials) if the application is on a light duty cabinet door or such. The concealed hinge 10 may be made from by casting, machining, extrusion, etc.

What is claimed is:

1. A concealed hinge, comprising:

a first housing, wherein the first housing holds a first pin and a second pin in a fixed position;

a second housing; wherein the second housing holds a third pin and a fourth pin in a fixed position;

a linkage, the linkage comprises a central link, an upper link, and a lower link;

the central link includes an inner end and an outer end, wherein the inner end of the central link transitions into a first curved portion;

the upper link includes an inner end, a middle portion, and an outer end, the lower link includes an inner end, a middle portion, and an outer end, wherein, in a closed position of the concealed hinge, the inner ends of the upper and lower links angle away inwardly from an opening in the first housing and then curve back outwardly toward the opening and then transition into the middle portions; and, wherein the first pin and the second pin engage the first housing to the linkage, and the third pin and the fourth pin engage the second housing to the linkage, and wherein the linkage rotates relative to the first pin, the second pin, the third pin, and the fourth pin.

2. The concealed hinge according to claim 1, wherein the central link is positioned between the upper link and the lower link.

3. The concealed hinge according to claim 1, wherein the first curved portion forms a semi-circular shape.

4. The concealed hinge according to claim 1, wherein the first housing has a larger volume than the second housing, and the first housing accommodates the first curved portion of the central link.

5. The concealed hinge according to claim 1, wherein the upper and lower links include a substantially similar construction.

6. The concealed hinge according to claim 1, wherein the inner ends of the upper and lower links are shorter than the middle portions and the outer ends of the upper and lower links.

7. The concealed hinge according to claim 6, wherein the inner ends of the upper and lower links form an approximate 45 degree angle relative to the middle portions, wherein the middle portions transition into the outer ends, wherein the middle portions form an approximate 135 degree angle relative to the outer ends.

8. The concealed hinge according to claim 1, wherein the first housing includes the opening defined by a bottom wall, a top wall, a front wall, and a rear wall, wherein the opening leads into an interior of the first housing, wherein the first pin and the second pin extend from the bottom wall of the first housing to the top wall of the first housing.

9. The concealed hinge according to claim 8, wherein the first pin is closer to the opening than the second pin.

10. The concealed hinge according to claim 1, wherein a lateral wall of the first housing leads to the opening of the first housing, and the lateral wall has a curved shape to approximately match the first curved portion of the central link.

11. The concealed hinge according to claim 10, wherein the second housing includes an opening defined by a bottom wall, a top wall, a front wall, and a rear wall, wherein the opening leads into an interior of the second housing, and wherein the third pin and the fourth pin extend from the bottom wall of the second housing to the top wall of the second housing.

12. The concealed hinge according to claim 11, wherein the fourth pin is positioned closer to the rear wall than the third pin.

13. The concealed hinge according to claim 1, wherein the inner end of the central link includes an opening, and the second pin passes through the opening, and the central link rotates relative to the second pin.

14. The concealed hinge according to claim 1, wherein the inner end of the upper link includes an opening, the inner end of the lower link includes an opening, and the first pin passes through the openings, and the upper link and the lower link rotate relative to the first pin.

15. The concealed hinge according to claim 1, wherein the outer end of the central link includes an opening, the fourth pin passes through the opening, and the central link rotates relative to the fourth pin.

16. The concealed hinge according to claim 1, wherein the outer end of the upper link includes an opening, the outer end of the lower link includes an opening, the third pin passes through the openings, and the upper link and the lower link rotate relative to the third pin.

17. The concealed hinge according to claim 1, wherein the upper and lower links include inner ends, middle portions, and outer ends, wherein the concealed hinge opens until the inner ends hit a front wall of the first housing.

18. The concealed hinge according to claim 1, wherein the first housing holds the first pin and the second pin in a rotating engagement in the fixed position.

19. The concealed hinge according to claim 1, wherein the second housing holds the third pin and the fourth pin in a rotating engagement in the fixed position.

20. A concealed hinge, comprising:

a first housing, wherein the first housing holds a first pin and a second pin in a fixed position;

a second housing; wherein the second housing holds a third pin and a fourth pin in a fixed position;

a linkage, the linkage comprises a central link, an upper link, and a lower link;

the central link includes an inner end and an outer end, wherein the inner end of the central link transitions into a first curved portion;

the upper link includes an inner end, a middle portion, and an outer end, the lower link includes an inner end, a middle portion, and an outer end, wherein each inner end of the upper and lower links forms a curved portion;

the first curved portion of the inner end of the central link forms a longer curving radius than that of the curved portion of the inner ends of the upper and lower links;

wherein the first pin and the second pin engage the first housing to the linkage, and the third pin and the fourth pin engage the second housing to the linkage;

wherein the inner end of the upper link includes a first opening, the inner end of the lower link includes a second opening, and the first pin passes through the first and second openings, and the upper link and the lower link rotate relative to the first pin;

wherein the inner end of the central link includes a third opening, and the second pin passes through the third opening, and the central link rotates relative to the second pin; and, wherein the outer end of the central link includes an opening, the fourth pin passes through the opening, and the central link rotates relative to the fourth pin.

21. A compartment and door, comprising:

a compartment;

a door;

a hinge, the hinge provides a rotatable engagement between the door and the compartment, the hinge comprising:

a first housing attached to the compartment, wherein the first housing holds a first pin and a second pin in a fixed position;

a second housing attached to the door, wherein the second housing holds a third pin and a fourth pin in a fixed position;

a linkage, the linkage comprising a central link, an upper link, and a lower link;

the central link includes an inner end and an outer end, wherein the inner end of the central link transitions into a first curved portion;

the upper link includes an inner end, a middle portion, and an outer end, the lower link includes an inner end, a middle portion, and an outer end, wherein, in a closed position of the concealed hinge, the inner ends angle away inwardly from an opening in the first housing and then curve or angle back outwardly toward the opening and then transition into the middle portions; and, wherein the first pin and the second pin engage the first housing to the linkage, and the third pin and the fourth pin engage the second housing to the linkage.

* * * * *